US006639352B2

(12) United States Patent
Eom

(10) Patent No.: US 6,639,352 B2
(45) Date of Patent: Oct. 28, 2003

(54) FLAT LAMP FOR EMITTING LIGHTS TO A SURFACE AREA AND LIQUID CRYSTAL USING THE SAME

(75) Inventor: Sun Kwan Eom, Daejon-Kwangyokshi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 60 days.

(21) Appl. No.: 09/893,774

(22) Filed: Jun. 29, 2001

(65) Prior Publication Data

US 2002/0067122 A1 Jun. 6, 2002

(30) Foreign Application Priority Data

Dec. 4, 2000 (KR) ..... P2000-72916

(51) Int. Cl.[7] ..... H01J 1/62; H01J 63/04

(52) U.S. Cl. ..... 313/493; 313/484; 313/485; 313/582

(58) Field of Search ..... 313/493, 484, 313/485, 491, 496, 582

(56) References Cited

U.S. PATENT DOCUMENTS 4,703,229 A * 10/1987 Nighan et al. ..... 315/169.4
5,525,857 A * 6/1996 Gnade et al. ..... 313/309
5,556,316 A * 9/1996 Taylor et al. ..... 313/309
5,726,524 A * 3/1998 Debe ..... 313/309
5,821,679 A * 10/1998 Makishima ..... 313/310
5,894,189 A * 4/1999 Ogasawara et al. ..... 313/310
5,926,239 A * 7/1999 Kumar et al. ..... 349/69
6,274,881 B1 * 8/2001 Akiyama et al. ..... 257/10
6,281,621 B1 * 8/2001 Nakamoto et al. ..... 313/309
6,285,123 B1 * 9/2001 Yamada et al. ..... 313/495
6,452,328 B1 * 9/2002 Saito et al. ..... 313/495
6,509,701 B1 * 1/2003 Rakhimov et al. ..... 315/363
6,512,501 B1 * 1/2003 Nagaoka et al. ..... 345/66

* cited by examiner

*Primary Examiner*—Vip Patel
*Assistant Examiner*—Kevin Quarterman
(74) *Attorney, Agent, or Firm*—Morgan, Lewis & Bockius LLP

(57) ABSTRACT

A flat lamp for emitting light to a surface area includes a planar cover formed of a transparent material, an anode formed on a rear surface of the planar cover; the rear surface of the planar cover coated with a fluorescent material, a bottom coupled with the rear surface of the cover to form a sealed inner space between the bottom and the rear surface of the cover, a cathode formed on a surface of the bottom internal to the sealed inner space, power supply means electrically connected to the anode and the cathode to supply an external power source, and a plasma-discharging gas injected into the sealed inner space, wherein visible light is produced uniformly over an entire surface of the cover by a reaction between the plasma-discharging gas and an electric field generated between the cathode and the anode.

12 Claims, 3 Drawing Sheets

FLAT LAMP FOR EMITTING LIGHTS TO A SURFACE AREA AND LIQUID CRYSTAL USING THE SAME

The present invention claims the benefit of Korean Patent Application No. P2000-72916 filed in Korea on Dec. 4, 2000, which is hereby incorporated by reference.

BACKGROUND OF THE INVENTION

1. Field of the Invention

The present invention relates to a flat lamp for emitting light to a surface area and a liquid crystal display using the same, and more particularly to a flat lamp implemented as an independent illuminator.

2. Background of the Related Art

A liquid crystal display (LCD) device generally provides image effects using characteristics attained by injecting liquid crystals between a lower substrate having thin film transistors and an upper substrates having color filters. In accordance with the operating principles of the LCD device, once a voltage is applied to transparent electrode plates disposed inside glass substrates, the direction of molecular motion of liquid crystals is separated. Accordingly, the amount of light passing through gaps between the liquid crystals varies, thereby creating an image.

Such a LCD device has an overall smaller size, reduced weight, and lower power consumption as compared to conventional cathode ray tube devices. However, since a LCD panel of a LCD device is non-luminous, the LCD panel needs an additional light source, i.e. a backlight assembly. Light sources used for the backlight assembly may be classified into at least three different categories: a point light source of a white halogen lamp; a linear light source of a fluorescent lamp; and a planar light source of an electro-luminescence (EL) or light emitting diode (LED). However, the light source which is widely used in conventional backlight assemblies is a linear light source using a cold cathode fluorescence lamp (CCFL) that has a long lifespan and excellent spectroscopic characteristics.

Reference will now be made in detail to a backlight assembly to which the CCFL is applied in a LCD device, examples of which are illustrated in the accompanying drawings.

FIG. 1 shows an edge-type backlight assembly to which a fluorescent lamp is applied in a liquid crystal display according to a related art, and FIG. 2 shows a disassembled plan view of a backlight assembly according to the related art shown in FIG. 1.

In FIG. 1, a backlight assembly is placed at a rear surface of a LCD panel (not shown in the drawing) which displays image data, and a main support 1 and a cover 3 that protects the main support 1. A lamp assembly is placed at one end of the main support 1, and a light guiding plate (LGP) 5 that transmits light emitted from the lamp 10 to the LCD panel is placed at a lateral side of the lamp 10. A reflection sheet 4 for reflecting any light that may leak out from the lamp is placed at a lower surface of the light guiding plate 5. A lower diffusion sheet 6 and an upper diffusion sheet 9 that diffuse incident light coming from the light guiding plate 5 are placed at an upper surface of the light guiding plate 5. A lower prism sheet 7 and an upper prism sheet 8 that condense and transmit light to the LCD panel are placed between the lower diffusion sheet 6 and the upper diffusion sheet 9. Accordingly, the backlight assembly requires at least the light guiding plate 5, the lower diffusion sheet 6, the upper diffusion sheet 9, the lower prism sheet 7, and the upper prism sheet 8 to uniformly supply light irradiated from the fluorescent lamp to the display surface.

In FIG. 2, the process of assembling the backlight assembly is performed by inserting a high pressure side lamp wire 13*a* and a low pressure side lamp wire 13*b* of a connector 16 into a high pressure lamp holder 12*a* and a low pressure lamp holder 12*b*, respectively, and then soldering the high pressure side lamp wire 13*a* and the low pressure side lamp wire 13*b* to a high pressure side and a low pressure side of the lamp 11, respectively. Then, the lamp assembly is completed by mounting a soldering part 14 of the lamp on a lamp housing 15 by covering a soldering part of the lamp with the lamp holders of the lamp. Subsequently, the lamp assembly is placed into the main support 1, and the cover 3 is inserted into a light entrance of the main support 1 in order to protect the lamp assembly from any external shocks. Then after the reflection sheet 4 has been mounted on an internal bottom surface of the main support 1, the light guiding plate 5 is inserted inside an internal gap of the lamp housing. It is important that the gap dimensions and planarity of the lamp housing remain straight. Finally, the lower diffusion sheet 6, the lower prism sheet 7, the upper prism sheet 8, and the upper diffusion sheet 9 are sequentially assembled into an upper part of the light guiding plate 5.

The above backlight assembly emitting light by generating a glow discharge in the lamp once a power source is applied by connecting the connector 16 to a power supply. The light generated by the lamp is incident on the light entrance surface of the light guiding plate 5, and is reflected and scattered by printed dots disposed on a lower surface of the light guiding plate 5. Additionally, the reflection sheet 4 prevents light loss by reflecting any light that failed to be reflected and scattered by the printed dots of the guiding plate 5 back through a rear surface of the guiding plate 5. Then, the light is condensed in a vertical direction through the lower prism sheet 7 and upper prism sheet 8 and is scattered by the diffusion sheet 9. Finally, the light passes through the diffusion sheet 9 and is supplied to the rear surface of the LCD panel to represent image data.

As mentioned above, since the backlight assembly requires at least the light guiding plate 5, a process for forming a pattern of the printed dots on the lower surface of the guiding plate is required. In addition, a high technology process for casting and injection molding is also required. Therefore, the backlight assembly of the related art is high in product cost and low in product yield due to the complicated part sourcing and fabrication processes involved. Generally, defects of the backlight assembly of the related art are created in the sheet structures such as the light guiding plate, prism sheets, and reflection sheet. Specifically, one defect involves the bending of the light guiding plate which is short for its overall dimensions, and another defect involves scratches and/or particles that are found on the guiding plate, prism sheets and reflection sheet. Therefore, there is a limit on enlarging the size of a backlight assembly and accordingly, on increasing of the size of the display.

In order to solve the above problems, a direct-type backlight assembly is proposed that enables light to be supplied to the diffusion sheet directly without use of a light guiding plate by arranging a plurality of lamps on a rear surface of the diffusion sheet. However, the direct-type backlight assembly still requires diffusion and prism sheets to provide uniform light. Moreover, the edge- or direct-type backlight assemblies also fail to provide uniform light to an entire display surface with high brightness as well as wide visible angles.

SUMMARY OF THE INVENTION

Accordingly, the present invention is directed to a flat lamp for emitting light to a surface area and liquid crystal display using a flat lamp that substantially obviate one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages, and in accordance with the purpose of the present invention as embodied and broadly described, a flat lamp for emitting light to a surface area according to the present invention includes a planar cover formed of a transparent material, an anode formed on a rear surface of the planar cover, the rear surface of the planar cover coated with a fluorescent material, a bottom coupled with the rear surface of the cover to form a sealed inner space between the bottom and the rear surface of the cover, a cathode formed on a surface the of bottom internal to the sealed inner space, power supply means electrically connected to the anode and the cathode to supply an external power source, and a plasma-discharging gas injected into the sealed inner space, wherein visible light is produced uniformly over an entire surface of the cover by a reaction between the plasma-discharging gas and an electric field generated between the cathode and the anode.

In another aspect, a liquid crystal display device according to the present invention includes a liquid crystal display panel and a backlight assembly disposed at a rear surface of the liquid crystal display panel, including a rectangular planar cover disposed at the rear surface of the liquid crystal display panel, a bottom coupled with a circumferential portion of a rear surface of the cover to form a sealed inner space, an anode disposed on central portions of the rear surface of the cover internal to the sealed inner space, a cathode disposed on a surface of the bottom internal to the sealed inner space, power supply means electrically connected to the anode and the cathode to supply an external power source, and a plasma-discharging gas injected into the sealed inner space between the cover and the bottom.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
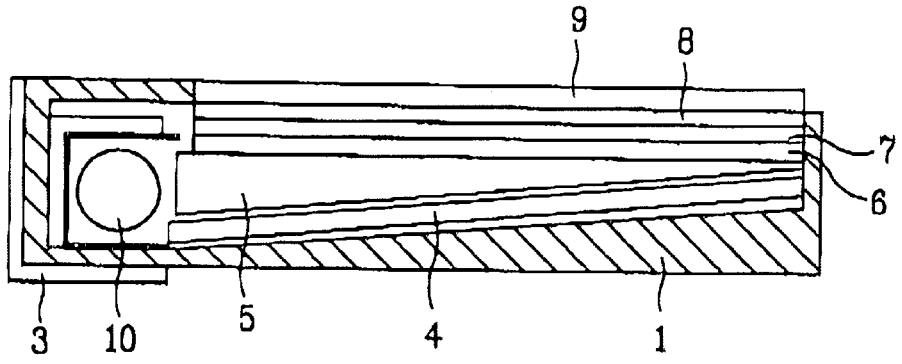
FIG. 1 Prior Art
FIG. 1 shows a backlight assembly according to a related art.
Figure 2:
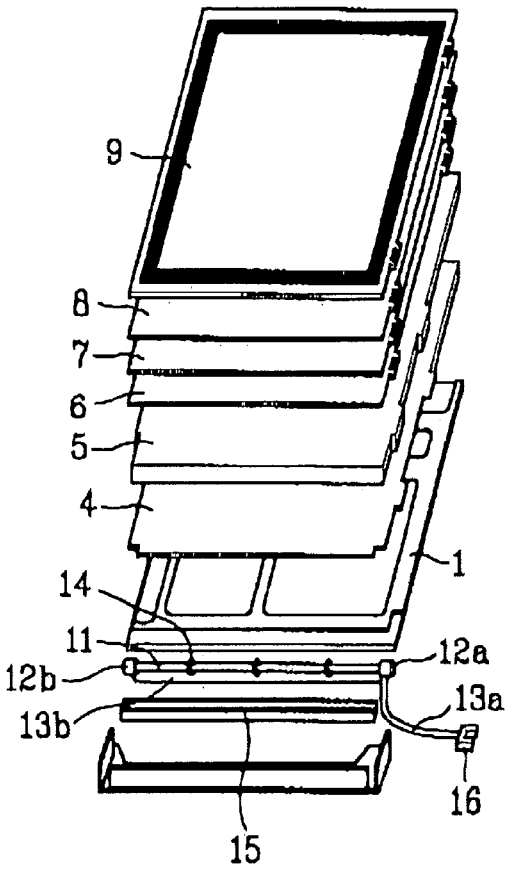
FIG. 2 Prior Art
FIG. 2 shows a disassembled plan view of a backlight assembly according to a related art.

Reference will now be made in detail to embodiments of the present invention, examples of which are illustrated in the accompanying drawings. Where possible, the same reference numerals will be used to illustrate like elements throughout the specification.

As will be explained in detail below, a liquid crystal display according to the present invention provides for large-sized display products by fabricating a backlight assembly that provides a rear surface of an LCD panel with a high brightness light source without requiring additional components such as a light guiding plate, for example.

Figure 3:
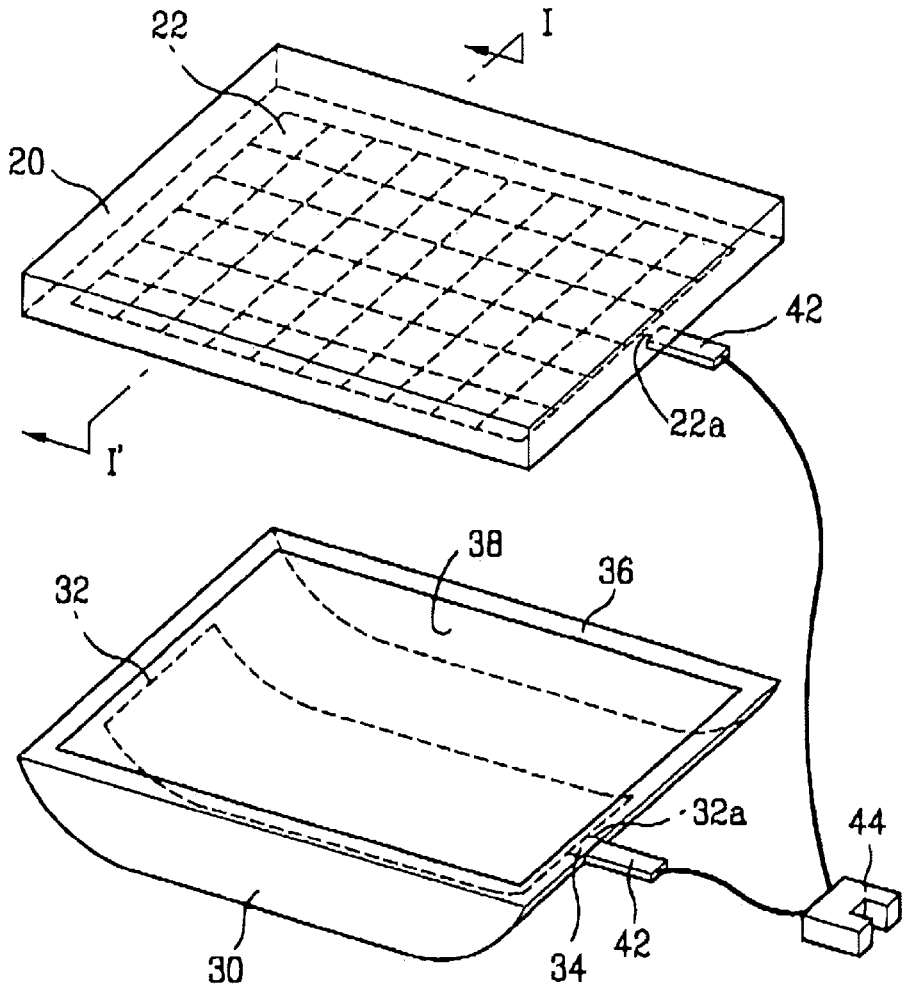
FIG. 3 shows a backlight assembly including a fluorescent lamp to be used in a liquid crystal display device according to an embodiment of the present invention.

FIG. 3 shows a backlight assembly including a fluorescent lamp to be used in a liquid crystal display according to an embodiment of the present invention.

In FIG. 3, a flat lamp for emitting light to surface area according to an embodiment of the present invention includes a cover 20 in which an anode 22 is formed, a bottom 30 in which a cathode 32 is formed, a power supply means applying an external power source to the anode 22 and cathode 32, and a plasma-discharging gas injected between the cover 20 and the bottom 30. The cover 20 may have a rectangular, round, or triangular shape, or a variety of other shapes, in accordance with the shape of a display surface. As an example, the rectangular shaped cover 20 is shown in the drawing. The cover 20 is used to supply surface light and is formed of a transparent material for receiving and transmitting visible light. The anode 22 is connected to an external power supply and is formed on a rear surface of the cover 20, and an upper part of the anode 22 is coated with a fluorescent material 24.

Figure 4:
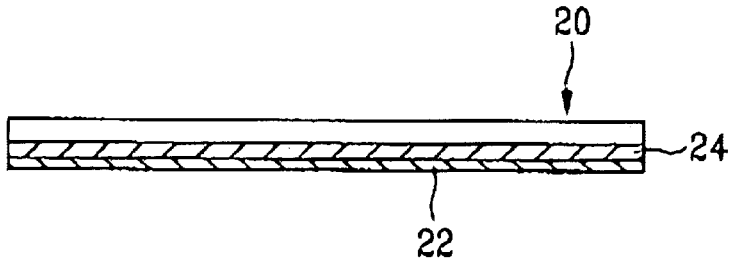
FIG. 4 is a cross-sectional view along line I–I' of the cover of the flat lamp shown in FIG. 3.

FIG. 4 is a cross-sectional view along line I–I' of the cover 20 in FIG. 3 according to the present invention.

In FIG. 4, the cover 20 of the flat lamp coated with a fluorescent material 24. The anode 22 is evenly distributed to uniformly emit light though an entire surface of the cover 20. As an example the anode 22 is formed with lattices provided by crossing orthogonal horizontal and vertical lines traversing the rear surface of the cover 20. Furthermore, the anode 22 may be formed by printing a transparent material on the rear surface of the cover 20 to prevent the shape of the anode 22 from being externally shown through the cover 20 of the flat lamp. The bottom 30 of the flat lamp provides a sealed space together with the rear surface of the cover 20, and the cathode 32 is formed within the bottom 30. The cathode 32 is disposed on a surface of the bottom 30 and emits electrons when connected to the external power supply. The cathode 32 is evenly distributed within the bottom 30 to generate a uniform electric field. However, within the resulting plasma, specific motion of the electrons emitted from the cathode 32 is difficult to predict. Yet, an electron density in a middle area of the bottom 30 is higher than an electron density at edges of the bottom 30 since the electrons emitted from the cathode 32 from all directions gather in the middle area of the bottom 30. Accordingly, a brightness difference occurs between circumferential and central parts of the cover 20. In order to cancel the brightness difference, the shape of the bottom 30 is formed such that an internal surface is curved toward the edges in order to broaden a projected area that corresponds to a predetermined area of the cover 20. As a result, the electrode density is increased in the predetermined area of the cover 20. The cover 20 may be formed of a transparent material that is able to withstand the high temperature of the plasma and includes at least glass, heat-resistant resin, metal or oxide.

The bottom 30 may have different shapes including a complete hemisphere of which a side is open, a curved surface having constant curvature from a center of a lower surface to a lateral side, or a slant surface having a constant slope, for example. Accordingly, the bottom 30 may be formed in a shape of a hexagon to correspond to the rectangular shape of the cover 20. Specifically, short lateral sides surrounding the lower surface of the bottom 30 are formed as a curved surface with a predetermined curvature ratio. Accordingly, the cathode 32 is formed of a film including at least Pt, Au, Ag, and Cr, for example, that is coated on both short lateral sides of the bottom 30. Therefore, the bottom 30 enables an increase in the electrode density at the curved edges, thereby providing a light source having uniform brightness at the central and circumferential parts of the cover 20. In order to prevent light loss, a face 38 and its corresponding lower surface of the bottom 30 where the cathode is not formed is coated with a reflection layer. A junction surface 36 that will be coupled with the rear surface of the cover 20 is formed at four corners of the open upper surface of the bottom 30, thereby enabling the sealed space formed between the cover 20 and bottom 30. A gas inlet 34 is formed at one side of the junction surface 36. Subsequently, the gas inlet 34 is sealed after the plasma-discharging gas has been injected into the sealed space between the cover 20 and the bottom 30.

The power supply means includes a connector that is connected to a power supply and a pair of flexible printed circuit (FPC) substrates 42 that connect wires extending from the connector 44 to the anode 22 and the cathode 32. One of the FPC substrates 42 is connected to one end 22*a* of the anode 22 and another one of the FPC substrates 42 is connected to one end 32*a* of the cathode 32. By using the FPC substrates 42, bending flexibility can be achieved. Furthermore, the FPC substrate 42 installed in the bottom 30 may be connected to the end 32*a* of the cathode through the gas inlet 34.

During operation of the flat lamp, the electrons emitted from the cathode collide with the inert gas to produce a plasma that generates ultraviolet radiation. The ultraviolet radiation then excites the fluorescent material 24 disposed on the cover 20, to produce visible light. The production of visible light occurs simultaneously and frequently in the space between the cover 20 and bottom 30. As a result, light with high brightness is provided at central and circumferential parts of the cover 20 because of the shape of the bottom 30. Moreover, a flat lamp according to the present invention can maximize the size of the display and provide light for an entire display surface with uniformity and high brightness, as well as provide a display device having wide viewable angles. Further, a flat lamp according to the present invention provides for a simplified fabrication process by reducing the number of components, and reduces a failure ratio of the device.

Figure 5:
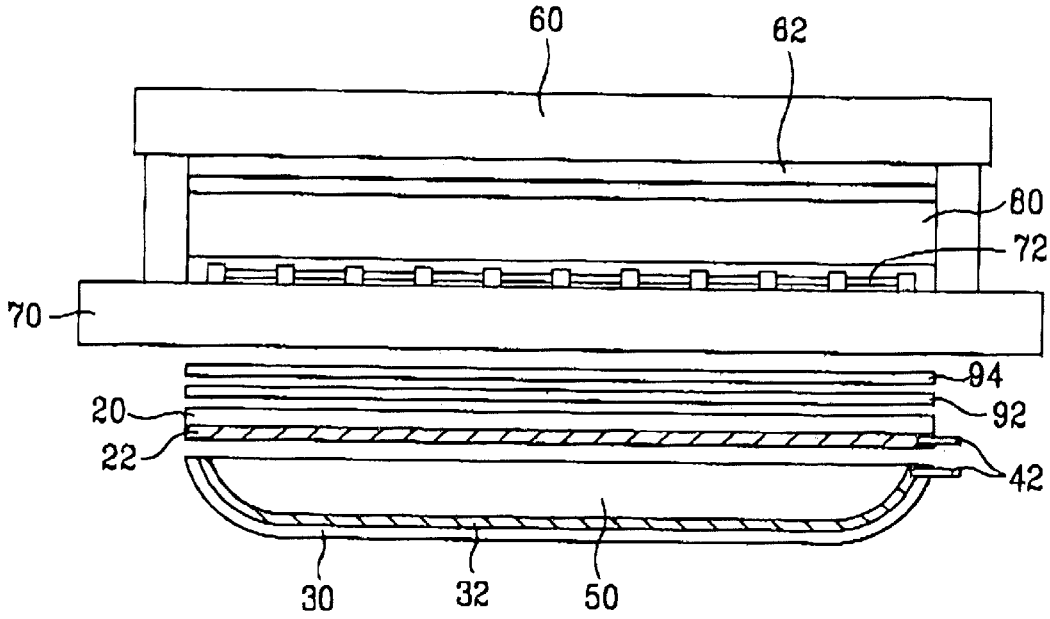
FIG. 5 shows a schematic structure of a liquid crystal display according to an embodiment of the present invention.

FIG. 5 shows a liquid crystal display according to an embodiment of the present invention.

In FIG. 5, a liquid crystal display includes a LCD panel that represents image data and a backlight assembly disposed at a rear surface of the LCD panel to function as a light source. The LCD panel includes a lower glass substrate 70 upon which thin film transistors 72 are disposed, an upper glass substrate 60 upon which a color filter 62 is disposed, and liquid crystals 80 injected between the lower glass substrate 70 and the upper glass substrate 60.

The backlight assembly includes a planar cover 20 disposed at a rear surface of the lower glass substrate 70 wherein an anode 22 and a fluorescent material are disposed, a bottom 30 coupled with the rear surface of the cover 20 wherein a cathode 32 is formed at an inner surface of the bottom 30, an FPC substrate 42 connected to ends of the anode 22 and the cathode 32 and to a connector 44 (in FIG. 3) to supply an external power source, and a plasma-discharging gas 50 injected between the cover 20 and bottom 30. Since a display surface of the LCD panel is generally rectangular, a shape of the cover 20 is correspondingly rectangle as well in this particular embodiment.

A plurality of sheets, such as diffusion sheet 92 and prism sheet 94, enable the device to provide more uniform brightness as well as a wide viewable angle and may be installed between the backlight assembly and LCD panel, i.e. on an upper surface of the cover. Accordingly, a flat lamp for emitting light according to the present invention is applied to a liquid crystal display, thereby attaining high brightness by providing a uniform light source having high directiveness over an entire display surface. Furthermore, the liquid crystal display according to the present invention may be driven with lower power consumption using the flat lamp according to the present invention. Moreover, the present invention simplifies a fabrication process by reducing the number of required parts as well as decreases the product failure ratio.

It will be apparent to those skilled in the art that various modifications and variations can be made in the flat lamp and liquid crystal display device of the present invention without departing from the spirit or scope of the invention. Thus, it is intended that the present invention covers the modifications and variations of this invention provided they come within the scope of the appended claims and their equivalents.

What is claimed is:

1. A flat lamp for emitting light to a surface area, comprising:

a planar cover formed of a transparent material;

a fluorescent material on an entire rear surface of the planar cover;

an anode formed on the rear surface of the planar cover;

a bottom coupled with the rear surface of the planar cover to form a sealed inner space between the bottom and the rear surface of the planar cover;

a cathode formed on a surface of the bottom internal to the sealed inner space;

power supply means electrically connected to the anode and the cathode to supply an external power source; and a plasma-discharging gas injected into the sealed inner space, wherein visible light is produced uniformly over an entire surface of the planar cover by a reaction between the plasma-discharging gas and an electric field generated between the cathode and the anode.

2. The flat lamp according to claim 1, wherein the anode is a transparent electrode.

3. The flat lamp according to claim 1, wherein the anode has a lattice shape including electrically conductive orthogonal horizontal lines and vertical lines.

4. The flat lamp according to claim 1, wherein the cathode includes a film disposed upon the surface of the bottom internal to the sealed inner space.

5. The flat lamp according to claim 1, wherein edges of the surface of the bottom internal to the sealed inner space is a curved surface for increasing electrode density.

6. The flat lamp according to claim 1, wherein a sealable gas inlet is formed at one side of a junction surface between the bottom and the cover.

7. The flat lamp according to claim 1, wherein the power supply means includes a connector electrically connected to the external power source, and a pair of flexible printed circuit substrates electrically connected between ends of the cathode and the anode and wires extending from the connector.

8. The flat lamp according to claim 7, wherein one of the pair of flexible printed circuit substrates is electrically connected to one end of the cathode through a sealable gas inlet.

9. The flat lamp according to claim 1, wherein the cover is at least made of one of glass and a heat-resistant resin.

10. The flat lamp according to claim 1, wherein the bottom is formed of one of glass, a heat-resistant resin, a metal and an oxide.

11. The flat lamp according to claim 1, wherein the cover has a rectangular shape and the bottom has a hexagonal shape of which an upper surface of the bottom is open except where a junction surface of the bottom is coupled with the cover.

12. The flat lamp according to claim 11, wherein short lateral sides of the bottom are curved in a lower surface direction to form a curved surface having a predetermined curvature ratio, and the short lateral sides and the lower surface of the bottom are coated with a film to form the cathode.

* * * * *